US005577986A

United States Patent [19]

Chen

[11] Patent Number: 5,577,986

[45] Date of Patent: Nov. 26, 1996

[54] POWER GENERATING EXERCISER

[76] Inventor: Yen-Shou Chen, No. 164, Sec. 2, Chung Shan Road, Hua Tan Hsiang, Chang Hua Hsien, Taiwan

[21] Appl. No.: 644,184

[22] Filed: May 10, 1996

[51] Int. Cl.[6] ..... A63B 21/00

[52] U.S. Cl. ..... 482/63

[58] Field of Search ..... 482/57, 62, 63, 482/900, 903, 58, 59

[56] References Cited

U.S. PATENT DOCUMENTS

| | | | |
|---|---|---|---|
| 4,298,893 | 11/1981 | Holmes | 482/63 |
| 4,613,129 | 9/1986 | Schroeder et al. | 482/63 |
| 5,139,255 | 8/1992 | Sollami | 482/62 |
| 5,310,392 | 5/1994 | Lo | 482/63 |

*Primary Examiner*—Stephen R. Crow
*Attorney, Agent, or Firm*—Beveridge, DeGrandi, Weilacher & Young, LLP

[57] ABSTRACT

A power generating exerciser comprises an exerciser and a power generating device. The exerciser has two longitudinal posts, a crossbar connecting the upper portions of the longitudinal posts, a shaft connecting the lower ends of the longitudinal posts, a transverse bar connecting a seat post and the crossbar, a lower end of the seat post connecting a transverse post. A U-shaped plate has two parallel arm plates to connect the corresponding longitudinal posts. Two opposite lobes are disposed on the corresponding arms. The power generating device has a generator, and a follower wheel passed through by a shaft, a driven wheel disposed between two lobes, a crank axle passing through two lobes and the driven wheel, and a belt surrounding the follower wheel and the driven wheel.

1 Claim, 2 Drawing Sheets

POWER GENERATING EXERCISER

BACKGROUND OF THE INVENTION

The present invention relates to a power generating exerciser. More particularly, the present invention relates to an exerciser which can drive a power generating device.

Some exercisers have brakes to retard the speed of exercising. Certain types of exercisers are driven by driving machines which need electric sources. These exercisers may waste the physical energy of the users. In order to utilize the physical energy of the user, it is necessary to provide an exerciser which can generate electric power.

SUMMARY OF THE INVENTION

An object of the present invention is to provide a power generating exerciser which can drive a power generating device to generate electric power.

Accordingly, a power generating exerciser comprises an exerciser and a power generating device. The exerciser has a first and second longitudinal posts, a crossbar connecting an upper portion of the first longitudinal post and an upper portion of the second longitudinal post, a shaft connecting a lower end of the first longitudinal post and a lower end of the second longitudinal post, a transverse bar connecting a seat post and the crossbar, a lower end of the seat post connecting a transverse post, a seat disposed on an upper end of the seat post. A generally U-shaped plate has a first and second parallel arm plates. The first and second longitudinal posts are in parallel. An end of the first arm plate connects the first longitudinal post. An end of the second arm plate connects the second longitudinal post. The first arm plate has a first lobe thereon. The second arm plate has a second lobe thereon. A first handle bar extends upward from an upper end of the first longitudinal post. A second handle bar extends upward from an upper end of the second longitudinal post. The power generating device has a generator disposed on a mount, a follower wheel disposed between the first and second longitudinal posts, a shaft passing through the generator, the first longitudinal post, the follower wheel and the second longitudinal post rotatably, a driven wheel disposed between the first and second lobes, a crank axle passing through the first lobe, the driven wheel and the second lobe, and a belt surrounding the follower wheel and the driven wheel. The crank axle has a first leg and an opposite second leg. A first pedal is disposed on the first leg. A second pedal is disposed on the second leg. The mount is disposed beside the first longitudinal post. The first and second pedals 143 are driven to rotate the driven wheel. The driven wheel drives the follower wheel to rotate. The follower wheel drives the shaft to rotate.

DETAILED DESCRIPTION OF THE INVENTION

Figure 2:
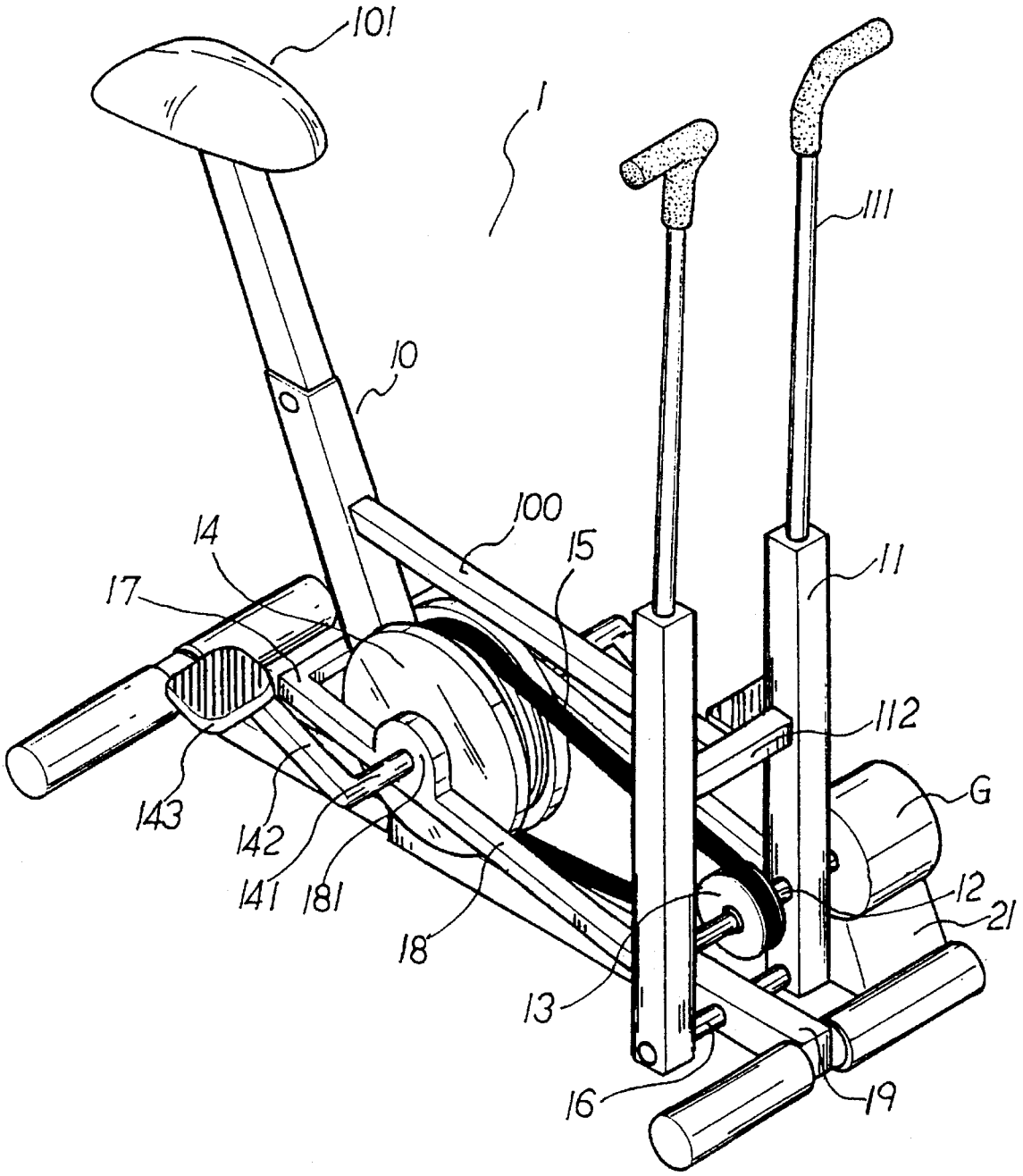
FIG. 2 is a perspective view of a power generating exerciser of a preferred embodiment in accordance with the present invention.

Referring to FIG. 2, a power generating exerciser 1 comprises an exerciser and a power generating device. The exerciser has a first and second longitudinal posts 11, a crossbar 112 connecting upper portions of the first and second longitudinal posts 11, a shaft 16 connecting a lower end of the first longitudinal post 11 and a lower end of the second longitudinal post 11, a transverse bar 100 connecting a seat post 10 and the crossbar 112, a lower end of the seat post 10 connecting a transverse post 19, a seat 101 disposed on an upper end of the seat post 10. A generally U-shaped plate 17 has a first and second parallel arm plates 18. The first and second longitudinal posts 11 are in parallel. An end of the first arm plate 18 connects the first longitudinal post 11. An end of the second arm plate 18 connects the second longitudinal post 11. The first arm plate 18 has a first lobe 181 thereon. The second arm plate 18 has a second lobe 181 thereon. A first handle bar 111 extends upward from an upper end of the first longitudinal post 11. A second handle bar 111 extends upward from an upper end of the second longitudinal post 11.

Figure 1:
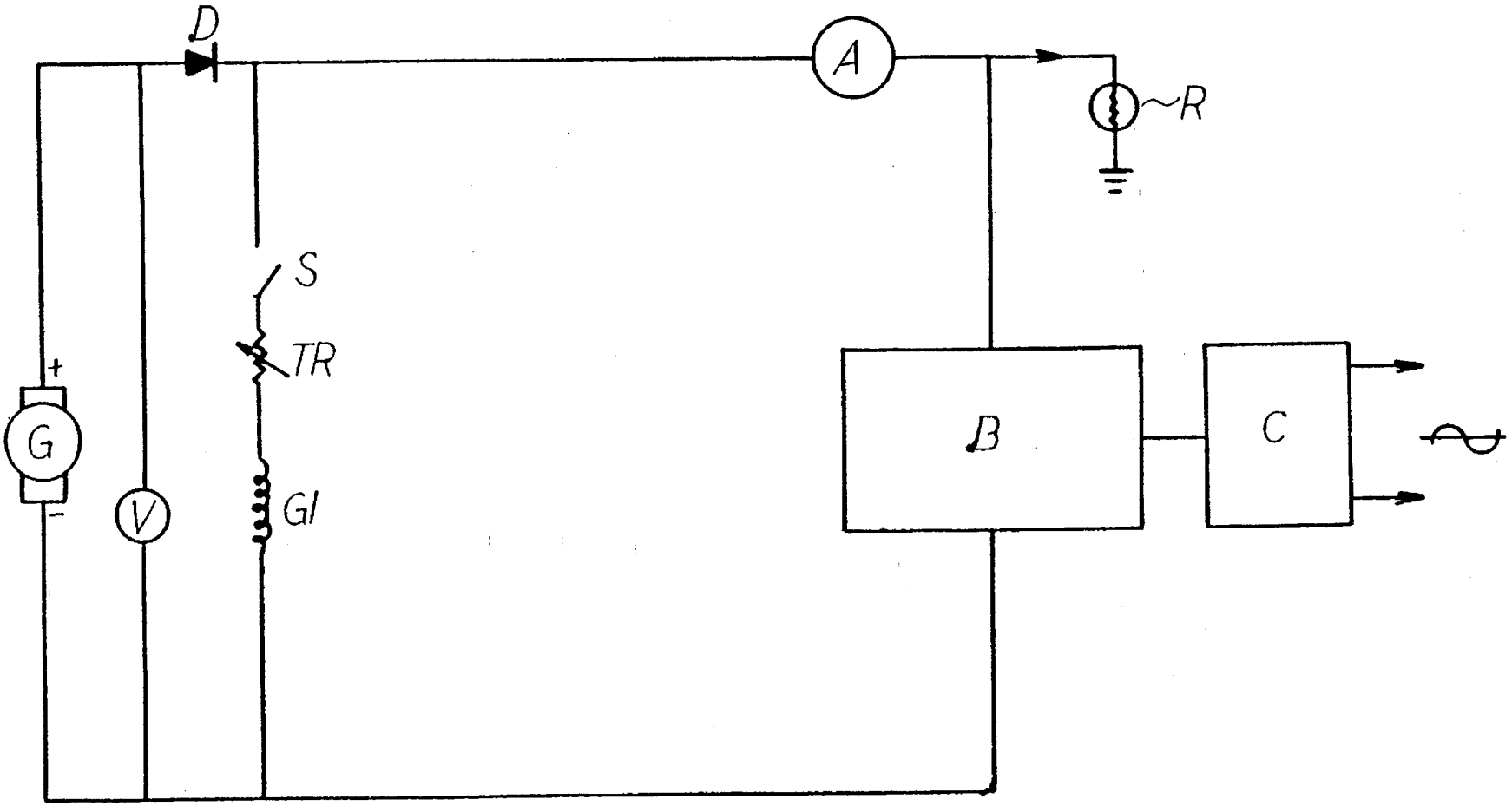
FIG. 1 is an electrical schematic view of a power generating device.

Referring to FIGS. 2 and 1, the power generating device has a generator G disposed on a mount 21, a follower wheel 13 disposed between the first and second longitudinal posts 11, a shaft 12 passing through the generator G, the first longitudinal post 11, the follower wheel 13 and the second longitudinal post 11 rotatably, a driven wheel 14 disposed between the first and second lobes 181, a crank axle 141 passing through the first lobe 181, the driven wheel 14 and the second lobe 181, and a belt 15 surrounding the follower wheel 13 and the driven wheel 14. The crank axle 141 has a first leg 142 and an opposite second leg 142. A first pedal 143 is disposed on the first leg 142. A second pedal 143 is disposed on the second leg 142. The mount 21 is disposed beside the first longitudinal post 11. The user can drive the first and second pedals 143 to rotate the driven wheel 14. The driven wheel 14 drives the follower wheel 13 to rotate. The follower wheel 13 drives the shaft 12 to rotate. Thus the genertor G begins to generate electricity. A coil G1, a variable resistor TR and a switch S are connected in series. The generator G, a voltmeter V and the switch S are connected in parallel. The generator G connects a diode D which connects an ammeter A. The ammeter A connects an accumulator B. A resistor R connects an accumulator B. The accumulator B connects a power transfer device C.

The invention is not limited to the above embodiment but various modification thereof may be made. Further, various changes in form and detail may be made without departing from the scope of the invention.

I claim:

1. A power generating exerciser comprising:

an exerciser having a first and second longitudinal posts, a crossbar connecting an upper portion of said first longitudinal post and an upper portion of said second longitudinal post, a shaft connecting a lower end of said first longitudinal post and a lower end of said second longitudinal post, a transverse bar connecting a seat post and said crossbar, a lower end of said seat post connecting a transverse post, a seat disposed on an upper end of said seat post.

a generally U-shaped plate having a first and second parallel arm plates, said first and second longitudinal posts being in parallel, an end of said first arm plate connecting said first longitudinal post, an end of said second arm plate connecting said second longitudinal post;

said first arm plate having a first lobe thereon;

said second arm plate having a second lobe thereon;

a first handle bar extending upward from an upper end of said first longitudinal post;

a second handle bar extending upward from an upper end of said second longitudinal post;

an power generating device having a generator disposed on a mount, a follower wheel disposed between said first and second longitudinal posts, a shaft passing through said generator, said first longitudinal post, said follower wheel and said second longitudinal post pivotally, a driven wheel disposed between said first and second lobes, a crank axle passing through said first lobe, said driven wheel and said second lobe, and a belt surrounding said follower wheel and said driven wheel;

said crank axle having a first leg and an opposite second leg;

a first pedal disposed on said first leg;

a second pedal disposed on said second leg;

said mount disposed beside said first longitudinal post;

wherein said first and second pedals are driven to rotate said driven wheel, said driven wheel drives said follower wheel to rotate, and said follower wheel drives said shaft to rotate.

* * * * *